United States Patent [19]

Jenkins et al.

[11] Patent Number: 4,830,111

[45] Date of Patent: May 16, 1989

[54] WATER WELL TREATING METHOD

[76] Inventors: Jerold D. Jenkins, 850 Vindicator Dr., Suite 212, El Paso, Colo. 80918; Craig D. Jenkins, 8789 W. Cornell Ave., Unit 10-6, Lakewood, Colo. 80227; Scott E. Jenkins, 658 S. Reed Court, Apt. NH 12, Lakewood, Colo. 80226

[21] Appl. No.: 94,416

[22] Filed: Sep. 9, 1987

[51] Int. Cl.[4] ..... E21B 37/00; E21B 43/27

[52] U.S. Cl. ..... 166/303; 166/68.5; 166/249; 166/312

[58] Field of Search ..... 166/302, 312, 303, 300, 166/249, 56, 61, 62, 68.5, 67, 177, 106, 105

[56] References Cited

U.S. PATENT DOCUMENTS

| | | | |
|---|---|---|---|
| 2,205,421 | 6/1940 | Layne | 166/68.5 |
| 2,309,697 | 2/1943 | Gunderson | 166/62 X |
| 2,349,536 | 5/1944 | Bancroft | 166/61 |
| 2,773,551 | 12/1956 | Warden et al. | 166/67 X |
| 2,858,890 | 11/1958 | McMahon | 166/302 X |
| 3,614,986 | 10/1971 | Gill | 166/303 |
| 3,650,324 | 3/1972 | Randles et al. | 166/68.5 |
| 3,899,027 | 8/1975 | Jenkins | 166/302 |
| 4,103,743 | 8/1978 | Paul | 166/312 X |
| 4,345,647 | 8/1982 | Carmichael | 166/68.5 X |
| 4,537,257 | 8/1985 | Todd | 166/106 X |

*Primary Examiner*—Hoang C. Dang

*Attorney, Agent, or Firm*—Fleit, Jacobson, Cohn & Price

[57] ABSTRACT

Water well treatment apparatuses and methods or procedures followed during such treatment in which fluids produced from the well are recycled through the well and aquifer with the recirculated fluids being subjected selectively to various treatment techniques to more effectively clean or otherwise treat the well and aquifer. By using various modifications of the basic arrangement, shallow wells and deep wells may be effectively treated and wells which use turbine pumps, submersible pumps and the like may also be effectively treated. The apparatus and method includes a structure for heating the recirculated fluid to desired temperature levels, adding various cleaning the treating solutions thereto, varying the parameters of the treatment methods in accordance with the conitions of the well and aquifer and purging the well when desired.

2 Claims, 2 Drawing Sheets

WATER WELL TREATING METHOD

BACKGROUND OF THE INVENTION

FIELD OF THE INVENTION

The present invention generally relates to water well treatment apparatuses and methods or procedures followed during such treatment and more particularly relates to water well treatment apparatuses and methods in which fluids produced from the well are recycled through the well and aquifer with the recirculated fluids being subjected selectively to various treatment techniques to more effectively clean or otherwise treat the well and aquifer. By using various modifications of the basic arrangement, shallow wells and deep wells may be effectively treated and wells which use turbine pumps, submersible pumps and the like may also be effectively treated. The apparatus and method includes a structure for heating the recirculated fluid to desired temperature levels, adding various cleaning and treating solutions thereto, varying the parameters of the treatment methods in accordance with the conditions of the well and aquifer and purging the well when desired.

INFORMATION DISCLOSURE STATEMENT

Prior U.S Pat. No. 3,899,027 issued Aug. 12, 1975 discloses an apparatus and method of treating a water well in which all or a portion of the fluid produced from the well can be recycled through the well and aquifer. Other patents exist which relate to treatment of wells for various purposes by injecting various fluids into underground strata for enhancing well production or for other purposes. However, the prior art does not include apparatuses and methods equivalent to the present invention. A separate information disclosure statement will be filed including copies of the above-mentioned patent and other patents known to applicants.

SUMMARY OF THE INVENTION

An object of the present invention is to provide water well treatment apparatuses and methods in which a portion of or all of the fluid produced by the well can be recirculated with the recirculated fluid being treated by heating or by the use of selected additives which distinguishes from prior art systems in which heating has been accomplished but without a recycle loop. The treated fluid is discharged directly into the upper end portion of the annulus so that it will fall in an unrestricted manner downwardly until it strikes the residual water in the casing with the impact causing a turbulent action that creates force waves within the residual water in the casing.

Another object of the invention is to provide a water well treatment apparatus and method that can be utilized with various types of wells such as shallow wells and deep wells provided with various types of pumps such as turbine pumps, submersible pumps and with various types or well structures including those drilled in confined aquifers and those in unconfined aquifers and including wells with unperforated casings with a well screen placed at the bottom of the well hole to allow water to enter from a specific zone such as a well in a confined aquifer and in a well having a perforated casing extending from the water table level to the bottom of the hole such as used in an unconfined aquifer.

A further object of the invention is to provide water well treatment apparatuses and methods with various modifications for application to different types of wells including the use of extension pipes extending downwardly from a turbine pump to the top of a well screen and the use of a turbine and inflatable packer when combined with a submersible pump and shroud.

Still another object of the invention is to provide water well treatment apparatuses and methods in which the apparatuses are relatively simple in construction and utilize conventional components in a unique manner to perform efficient treatment methods.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
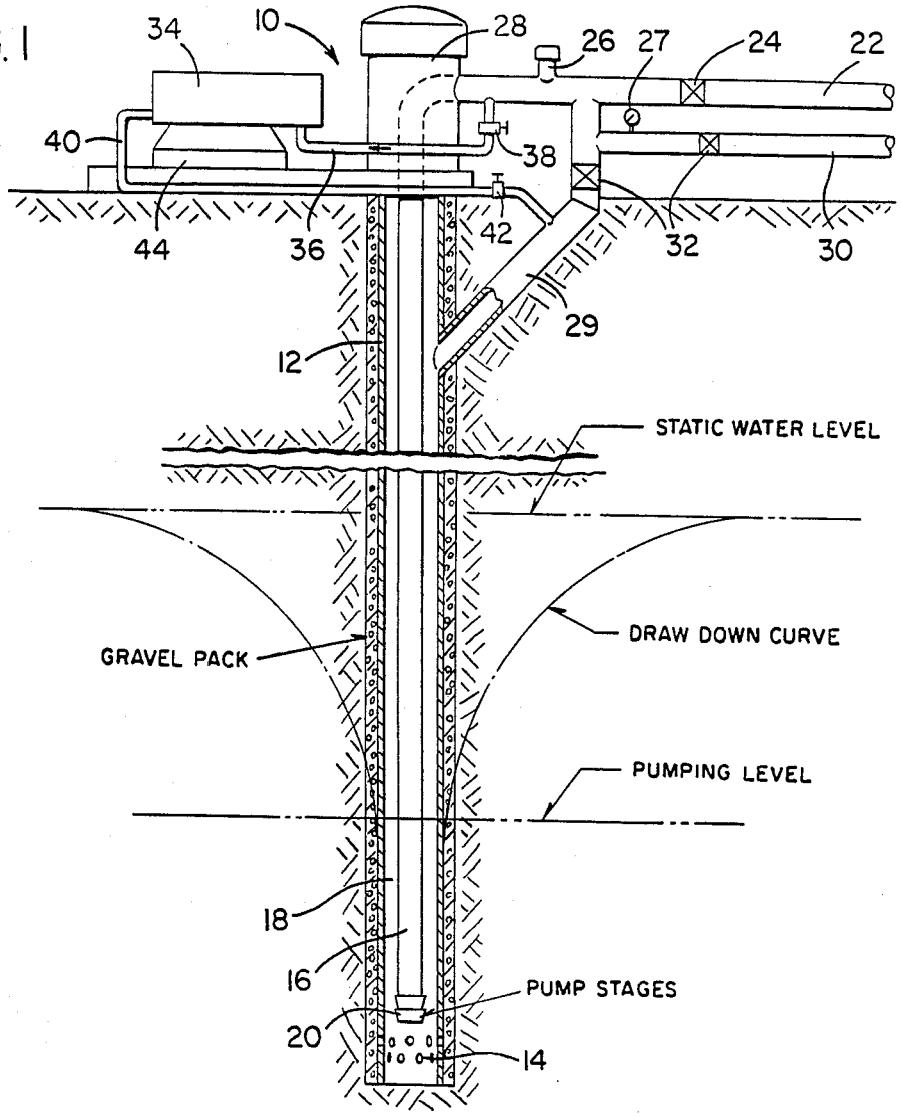
FIG. 1 illustrates a shallow well having a perforated casing and turbine pump.

Referring now specifically to FIG. 1, well 10 includes a casing 12 provided with perforations 14 in the upper and lower end thereof for association with an aquifer. The well casing includes a production tube or column pipe 16 spaced concentrically inwardly from the casing 12 with an annulus 18 provided between the casing and production tube. A multiple stage turbine pump assembly 20 is located at the lower end of the production tube or column pipe 16 with the upper end thereof communicating with a discharge pipe 22 having a valve 24 therein and a chemical injection and sampling nipple 26 incorporated therein. The upper end of the production tube may extend through a motor housing 28 which also houses the motor that drives the down hole pump 20.

Adjacent the upper end of the casing 12, a recirculating pipe 29 is provided which is in communication with the upper end portion of the annulus 18 at its lower end and is in communication with the discharge pipe 22 at its upper end. Also, a purge pipe or line 30 is communicated with the upper end portion of the recirculation pipe. The purge pipe 30 and the recirculating pipe 29 include fast acting valves with the fast acting valve 32 in the recirculation pipe being oriented below the connection between the purge pipe and the upper end of the recirculation pipe 29 which also communicates with the discharge pipe 22 inwardly of the valve 24 and on the discharge side of the injection or sampling nipple 26. A heat exchanger 34 is mounted adjacent the motor housing and adjacent the well head and includes an inlet pipe 36 communicated with the discharge pipe 22 upstream of the injection and sample nipple 26 with a valve 38 being incorporated into the inlet pipe 36. An outlet pipe 40 connects the heat exchanger 34 with the recirculation pipe 29 with a valve 42 incorporated into the outlet pipe 40. The heat exchanger is associated with a heating device generally designated by the numeral 44 to heat the fluid circulating through the heat exchanger to whatever temperature desired.

Figure 2:
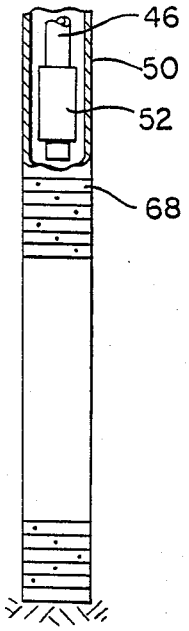
FIG. 2 is a schematic view illustrating a modification of FIG. 1 for use in deep wells utilizing a packer, unperforated casing and well screen.

FIG. 2 discloses a deep well application of the present invention in which the production tube or column pipe 16 is extended down below the bowls of the pump 20 with the extension pipe being designated by numeral 46 and is actually a suction pipe and may be constructed of rigid plastic material or the like. The suction pipe 46 terminates in the middle of a well screen 48 which forms an extension of an unperforated casing 50 The lower end portion of the suction pipe 46 is provided with a packer 52 which may be an inflatable packer or the like and is installed just above the well screen 48 although the position of installation may vary as long as it is below the pumping level.

Figure 3:
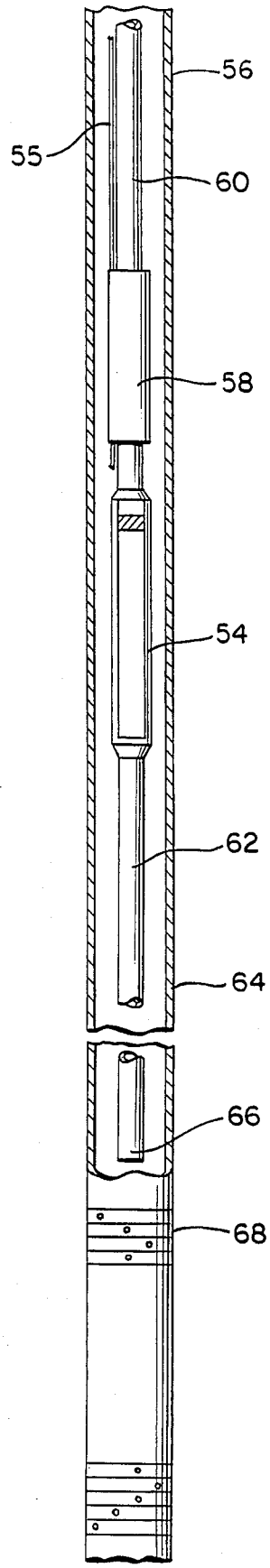
FIG. 3 is a schematic view illustrating a well treating apparatus and method utilizing a packer, submersible pump with shroud and a well screen at the bottom of an unperforated casing.

FIG. 3 discloses a modification of the invention in which a submersible pump with shroud is utilized as indicated by numeral 54 which is positioned centrally in the casing 56 with a packer 58 being provided above the pump 54 and mounted at any position on the production tube or column pipe 60. A pipe extension 62 extends from the lower end of the pump 54 through an unperforated casing 64 and terminates in a lower inlet or suction end 66 at the upper end of a well screen 68.

With the modifications of the invention, various installational requirements can be met including installation in a shallow well, a deep well and with various types of casings, perforations, well screens, pumps and aquifers. The recirculated fluid may be heated and chemical additives incorporated therein with the various parameters of materials, times and temperatures being varied depending upon conditions encountered.

The cleaning operation of a well may be divided into several phases. In an initial phase, sodium hypochlorite may be circulated at a concentration of from 500 to 1000 PPM for two to four hours after which the well is purged. A second phase may include circulation of a solution of sodium hexametaphosphate of between 100 to 500 PPM which is recirculated for 15 to 24 hours after which the well is again purged. A third phase of the cleaning operation involves injection of hydrochloric acid which may be a 15% solution circulated for a period of several hours. It is pointed out that the various concentrations and time parameters can vary. A significant novel feature of the apparatus and method is to provide the heat exchanger and heater so that the recirculated fluid can be heated either continuously or intermittently. Heating the fluid tends to expand the casing to remove and slough-off incrustations and provide some degree of movement between the exterior of the casing and the surrounding gravel pack which more effectively cleans the casing. The cleaning action is substantially enhanced by the water that is being recirculated and free-falling or dropping from approximately ground level to the static water level or pumping level which may be a distance of several hundred feet or more. The energy provided by the falling water when it impacts with the residual water in the annulus will create energy waves that will travel through the casing and aquifer for enhancing cleaning action.

During normal operation of the pump, the water level is drawn down from the static water level into a draw down cone as illustrated by the draw down curve in the drawings. During the recycling operation, the water reintroduced into the annulus will provide an elevated cone thus providing additional outward pressure into the aquifer to enhance the cleaning action of the recirculated fluid in the aquifer.

The procedure consists of recycling the water from the discharge pipe 22 through the recirculation pipe 29 so that the recycled water will fall downward in the annulus without restriction until it strikes the residual water in the casing. The impacting water causes a turbulent action that creates force waves within the casing. When the recycle mode commences, the water level in the casing is at its lowest point and, upon impacting, the water level elevates and the pressures increase and decrease with the fluctuations caused by the energy wave thus providing sequential pressure variations in and out through the perforations. When the system is in a recycle mode, no water is being discharged which causes the pumping level to rise to near the static level and this level will be maintained during the recycle mode. The time period from first impact of the falling water at the pumping level to when it reaches the static level is referred to as the recovery rate. The recovery rate should be divided into ten equal time parts so that the impact zone of the water fall travels upward from the pumping level a distance equal to 10% of the total distance and after this 10% travel has been obtained, the system should be purged which will again drop the pumping level back down to its lowest level so that a second cycle can then be started with the same procedure being used but the impact zone is allowed to rise to 20% of the total distance and this procedure is repeated through ten cycles. By this action, the entire wetted depth of the well has been bombarded by the impact zone of the water fall and the deepest part of the well has received the most energy since it is at the bottom of the cone of depression. This cycle will be used after each phase of the treatment process to insure a thorough cleaning of the casing, gravel pack and outside of the bore hole.

Various incrustations may be removed by the addition of acid. The acid most widely used for this purpose is hydrochloric although others can be used since calcium carbonate is the primary ingredient of incrustations. After the desired concentration of acid and type of acid has been determined, it is added to the recycle system and after complete mixing has occurred, the pump should continue to operate as necessary and the well should be purged before the action of the acid has been completed and the above described energy cycle should be used whenever the well is purged.

In order to remove silts and clays, the same procedure can be used as for incrustations except that the chemicals to be used may be various types of phosphates which take longer to act. In view of this, the system may be operated in the recycle mode for a period of one hour and the pump continued in operation for a period of four hours with purging done when necessary.

In order to sterilize a well, the recycling fluid should be heated to a temperature from 100° F. to 150° F. with 120° to 130° F. being preferred and calcium hypochlorite is used at a concentration of 100 to 500 PPM.

The above-described process will produce an increase in the porosity of most water wells thus increasing the specific capacity and yield. When used on a preventive maintenance program, high yields will be maintained. Since it is not necessary to remove the pumping unit from the well and down time is minimized, the treatment and cleaning process can be economically more feasible.

In the acid treatment process, the packer is used where the screens or perforations are below the pump bowls. When the system is in the recycle mode and the recirculating water has been heated, the pump is shut down and the packer is inflated. Since the screen is at the bottom of the hole, it becomes necessary to get the acid down to this region as undiluted as possible which is accomplished by pouring the acid down the column pipe followed by enough water to force all of the acid out of the column pipe. With all of the valves closed, the reaction gasses produced by the acid will cause pressures to develop which will force the acid further out into the aquifer with this pressure being monitored by a gauge 27 on the purge line. If the pressure becomes excessive, it can be reduced by venting out of the purge valve 32. When the reaction diminishes, the well can be purged until clean water is being pumped and then the packer can be deflated to check the specific capacity. The acid treatment can be repeated until no further increase is noted.

In removing silts and clays or sterilizing the well, the packer is not used as it remains deflated. As before, the recirculated water is heated so that superior action from the chemicals will take place. The heating unit is shut down and phosphates added to the recycling stream of water. Since it takes several hours for phosphate to function, the system can be operated on a recycling basis for one hour and then shut down for three hours after which the system and well is purged.

In sterilization, the recycling water is heated and calcium hypochlorite is added and the recycling mode is continued for one-half hour or longer and the system is then purged. Also, it is necessary to make some modifications depending upon the type of pump used. When a turbine pump is used, a down hole extension or suction pipe 46 is necessary which is extended into the bottom screen area and a packer is also necessary which is used to plug the annulus of the well. The packer can be inflated with air or liquid and can be controlled at the surface with the packer being fitted on the column pipe in the vicinity of the pumping water level and above the bowls.

When using a submersible pump, the packer will be placed in the same area as with a turbine pipe and a shroud is used around the submersible pump to insure that the water being pumped passes over the pump for temperature control. The shroud is merely a cover that is open on the bottom and is closed on the top that compels the water to flow around the pump and into the intake located at the top of the submersible pump. The suction line is attached onto the shroud and extends into the screened area. Inasmuch as the submersible pump has a check valve, the chemicals cannot flow down the discharge line to the screen area. Thus, a 1" acid injection line is needed and extends from the surface down through the packer and around the pump and enters a suction line by means of a fitting below the pump. This allows the chemicals to be pumped down this line entering the suction pipe so that they can travel to the screened area. This injection line is schematically illustrated in FIG. 3 and is designated by reference numeral 55.

When using the process in a confined aquifer the total volume of water being pumped is returned to the annulus during the recycle mode. The energy waves produced due to free fall of the water in the annulus is confined in the unperforated casing and is transmitted downward from the impact zone to the bottom of the hole. When the recycle mode is first started, the water level in the casing is at its lowest point and upon impacting, the water level elevates and the pressures increase and decrease with these fluctuations giving pressure variations at the screened area. As in the previous system, there is no water being discharged when in the recycle mode which forces the pumping level to rise to near the static level and maintained during the recycle mode of operation. During the recycle mode, water is falling or flowing downwardly in the annulus at high velocities and some of this water in its downward flow will bypass the end of the suction pipe and will result in a turbulent action at the screen area which also creates outward pressures at the screen area. Thus, by adjusting the valves at the surface, the resulting increased and decreased flows will create an inward and outward pressure sequence which will be significantly beneficial in cleaning the screen area. After treatment, the well will be purged until the water is clean.

One benefit from heating the recycled water is the resultant expansion of the well screen and casing for aiding in its cleaning. Also, heating will increase the efficiency of any chemicals that are added and once the water in the well has been heated, the energy cycle will be used to further clean the well. The recycling of cool water at the beginning of the cycle will contract the screen causing the completion of the expansion and contraction cycle.

In acidizing in a confined aquifer, the system is placed in the recycle mode and heated to a desired temperature with the pump being stopped and the packer inflated with all valves in the closed position. After determining the amount of acid needed, it is injected into the system through the injection nipple 26 and will travel down the column pipe or production tube 16 and since it is heavier than water, it will displace the water and flow downward to the bottom portion of the well. A sufficient amount of water should then be poured down the column pipe to displace all of the acid therein. A chemical reaction will start to occur since the acid comes into contact with the incrustating material and this reaction will cause gasses to form which will increase the down hole pressure. With the packer inflated, the only venting that can occur will be through the column pipe and the screens. Thus, this pressure can be monitored by the pressure gauge mounted on the discharge pipe of the pump and if this pressure becomes excessive, it can be vented through the purge line valve. A beneficial action of the pressure increasing is that it will force the acid outward through the screens into the aquifer. Any debris loosened by the acid action can be removed by using a sequestering agent in conjunction with the acid. Once the pressure drops in the well, the packer is deflated and the system is placed in the recycle mode and after the pH of the solution as well as the amount of the solids being carried in the recycle stream is determined, the system may be purged and the specific capacity checked to determined if another acid treatment is necessary.

In removing silts and clays in a confined aquifer, the recycle mode is used and the recycle fluid is heated to a desired temperature and conditioner is slowly added to the system and the recycle mode is continued for one out of every four hours, or the like, for a total of 16 hours after which the system is purged and the specific capacity checked and the treatment cycle repeated if necessary.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A method of treating a water well which includes an outer casing extending downwardly into an aquifer and in fluid communication with the aquifer, a pipe within the casing and spaced concentrically therefrom with a pump associated with the lower end of the pipe and casing for pumping water from the aquifer to above-ground surface into a discharge pipe, and a recycle pipe interconnecting the discharge pipe and the annulus between the casing and pipe therein consisting of the seeps of controlling flow of water for discharge from the discharge pipe and recirculating water from the discharge pipe through the recycle pipe into the annulus adjacent the upper end of the casing for free-fall of water in the annulus for impacting residual water in the annulus and heating the recirculated water, determining the recovery rate of water level in the annulus from the lowest pumping level when water is being pumped and discharged from the discharge pipe to a static water level when water is not being pumped and dividing the distance between the lowest pumping level and the static water level into multiple equal increments and recycling water with free-fall at each of the increment levels above the lowest pumping level thereby providing impact wave energy to each of the increment water levels of the aquifer between the lowest pumping level and the static water level.

2. The method as defined in claim 1 together with the step of packing off the annulus and injecting well treating material in the pipe and closing off all pipes and casing for retaining increased pressure in the pipe and annulus due to gas produced by the injected well treating materials.

* * * * *